US010210802B2

(12) United States Patent
Li

(10) Patent No.: US 10,210,802 B2
(45) Date of Patent: Feb. 19, 2019

(54) DRIVER CIRCUIT FOR OLED DISPLAY PANEL

(71) Applicant: Shenzhen China Star Optoelectronics Technology Co., Ltd., Shenzhen (CN)

(72) Inventor: Hao Li, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 203 days.

(21) Appl. No.: 15/119,382

(22) PCT Filed: Jun. 20, 2016

(86) PCT No.: PCT/CN2016/086428
§ 371 (c)(1),
(2) Date: Aug. 16, 2016

(87) PCT Pub. No.: WO2017/197701
PCT Pub. Date: Nov. 23, 2017

(65) Prior Publication Data

US 2018/0158404 A1 Jun. 7, 2018

(30) Foreign Application Priority Data

May 20, 2016 (CN) ..... 2016 1 0345482

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3275; G09G 3/3266; G09G 2300/0842;
(Continued)

(56) References Cited

U.S. PATENT DOCUMENTS

2006/0061527 A1* 3/2006 Peng ..... G09G 3/3233 345/77
2013/0027441 A1* 1/2013 Kabe ..... G09G 3/3413 345/690

(Continued)

FOREIGN PATENT DOCUMENTS

CN 1912974 A 2/2007
CN 102243839 A 11/2011

*Primary Examiner* — Srilakshmi K Kumar
*Assistant Examiner* — Brent D Castiaux
(74) *Attorney, Agent, or Firm* — Leong C. Lei

(57) ABSTRACT

The invention provides a driver circuit for OLED display panel, which comprises: a plurality of control signal output units (10), and a plurality of pixel light-emitting driver units (20) arranged in an array form, the plurality of control signal output units (10) respectively receiving a feedback control signal reflecting the ageing information of the OLED in a different active area of the OLED display panel, and each control signal output unit (10) correspondingly outputting an adjustable light-emitting control signal to at least a pixel light-emitting driver unit (20) according to the received feedback control signal to adjust the light emission time of the corresponding pixel light-emitting driver unit in a frame cycle so as to compensate the reduced luminance caused by aged OLED and improve the uneven luminance problem of OLED display panel.

13 Claims, 8 Drawing Sheets

(52) U.S. Cl.
CPC ..... *G09G 2300/0426* (2013.01); *G09G 2300/0819* (2013.01); *G09G 2300/0842* (2013.01); *G09G 2310/0248* (2013.01); *G09G 2320/0233* (2013.01); *G09G 2320/048* (2013.01)

(58) Field of Classification Search
CPC ... G09G 2300/0819; G09G 2300/0426; G09G 2320/048; G09G 2320/0233; G09G 2310/0248
See application file for complete search history.

(56) References Cited

U.S. PATENT DOCUMENTS

2013/0208019 A1* 8/2013 Lee ..... G09G 3/2018 345/690
2014/0028732 A1* 1/2014 Kim ..... G09G 3/3208 345/690

* cited by examiner

DRIVER CIRCUIT FOR OLED DISPLAY PANEL

BACKGROUND OF THE INVENTION

1. Field of the Invention

The present invention relates to the field of organic light-emitting diode (OLED) display, and in particular to a driver circuit for OLED display panel.

2. The Related Arts

The organic light-emitting diode (OLED) display panel, such as OLED TV has the advantages of self-luminous, low driving voltage, quick response, high clarity and contrast, near 180°, wide operating temperature range, capability to realize flexible display and large-area full-color display, are widely regarded as the most promising mainstream display technology, and widely used in applications.

OLED is a current driven element. When a current passes through the OLED, the OLED emits light. However, as the times goes on, the OLED will age and reduce the light-emission efficiency and the luminance. Thus, the OLED display panel shows the problem of Mura, an uneven luminance in display.

FIG. 1 shows a known OLED driver circuit, which comprises: a first thin film transistor (TFT) T1, a second TFT T2, a third TFT T3, a capacitor Cs, and an OLED D1, wherein the first TFT T1 has the gate inputting a light emission control signal EM1 for controlling the emission time of the OLED D1; the second TFT T2 is for driving the OLED D1 to emit light; for positive number n and m, the third TFT T3 has the gate inputting n-th scan signal Scan(n) and the source inputting the m-th data signal Data(m) to pre-charge the capacitor Cs, wherein the OLED pixel is positioned at the n-th column and the m-th row.

FIG. 2 shows a timing diagram of the driver circuit of FIG. 1. The cycle of a frame is divided into a pre-charge time and a light emission time, wherein during pre-charge time, the Scan signals Scan(1)-Scan(n) in pulse form are provided line-by-line in series, the light emission control signal EM10 controls all the first TFTs T1 in the OLED display panel to cut off to stop the OLED D1 from emission, the data signals Data(1)-Data(m) respectively input corresponding pixel driver circuit to complete the pre-charge of the entire frame; during light emission time, the light emission control signal EM10 makes all the first TFTs T1 in the OLED display panel conductive so that all the OLEDS D1 emit light. FIG. 3 shows a schematic view of duty cycle of the pre-charge time and light emission time in a frame cycle under the timing of a known OLED driver circuit. As shown in FIG. 3, the light emission time occupies a smaller portion in a frame cycle, and thus the light emission time for the OLED display panel is shorter and the frame luminance is lowered. To raise the luminance, the current must be raised, which will accelerate the ageing of the OLED. Moreover, the driver circuit only has a fixed-time light emission control signal EM10, which is neither able to compensate the reduced luminance caused by aged OLED nor solving the uneven luminance problem of OLED display panel.

SUMMARY OF THE INVENTION

The object of the present invention is to provide a driver circuit for OLED display panel, able to compensate the reduced luminance caused by aged OLED and improve the uneven luminance problem of the OLED display panel.

To achieve the above object, the present invention provides a driver circuit for OLED display panel, which comprises: a plurality of control signal output units, a plurality of pixel light-emitting driver units arranged in an array form, an n-th scan line, numbered from top, disposed along a horizontal direction corresponding to an n-th column of pixel light-emitting driver units, and an m-th data line, numbered from left, disposed along a vertical direction corresponding to an m-th row of pixel light-emitting driver units, wherein n and m both positive integers; the pixel light-emitting driver unit comprising a plurality of thin film transistors (TFT), an organic OLED, at least a capacitor, for driving the OLED to emit light; the plurality of control signal output units respectively receiving a feedback control signal reflecting the ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle; for more aged OLED, the corresponding adjustable light-emitting control signal controlling the light emission time of the pixel light-emitting driver unit to become longer in a frame cycle.

A control signal output unit is disposed to correspond to a column of pixel light-emitting driver units; the n-th control signal output unit receives the n-th feedback control signal reflecting the ageing information of the OLED in the n-th column of pixels of the OLED display panel and correspondingly outputs an n-th adjustable light-emitting control signal to the n-th column of pixel light-emitting driver units to adjust the light emission time of the n-th column of pixel light-emitting driver units in a frame cycle.

The pixel light-emitting driver unit comprises a first TFT, a second TFT, a third TFT, a capacitor, and an OLED; for the pixel light-emitting driver unit at the n-th column m-th row, the first TFT has the gate connected to receive the n-th adjustable light-emitting control signal, the source connected to the positive voltage of a power source, and the drain connected to the source of the second TFT; the second TFT has the gate connected to a node and the drain connected to the anode of the OLED; the third TFT has the gate connected to receive the scan signal from the n-th scan line, source connected to receive the data signal from the m-th data line, and the drain connected to the node; the capacitor has one end connected to the node and the other connected to the anode of the OLED; and the cathode of the OLED is grounded.

The n-th feedback control signal and the n-th adjustable light-emitting control signal are both single pulse signals, with opposite voltage level.

Optionally, the TFTs are N-type TFTs, and during the pre-charge time of the n-th columns of pixels, the n-th feedback control signal is high, the n-th adjustable light-emitting control signal is low, while during the light emission time of the n-th column of pixels, the n-th feedback control signal is low, the n-th adjustable light-emitting control signal is high.

The duration at the high level for the n-th feedback control signal is determined by the ageing information of the OLEDs of the n-th column of pixel light-emitting driver units.

Optionally, the TFTs are P-type TFTs, and during the pre-charge time of the n-th column of pixels, the n-th feedback control signal is low, the n-th adjustable light-emitting control signal is high, while during the light emission time of the n-th column of pixels, the n-th feedback control signal is high, the n-th adjustable light-emitting control signal is low.

The duration at the low level for the n-th feedback control signal is determined by the ageing information of the OLEDs of the n-th column of pixel light-emitting driver units.

The present invention also provides a driver circuit for OLED display panel, which comprises: a plurality of control signal output units, a plurality of pixel light-emitting driver units arranged in an array form, an n-th scan line, numbered from top, disposed along a horizontal direction corresponding to an n-th column of pixel light-emitting driver units, and an m-th data line, numbered from left, disposed along a vertical direction corresponding to an m-th row of pixel light-emitting driver units, wherein n and m both positive integers; the pixel light-emitting driver unit comprising a plurality of thin film transistors (TFT), an organic OLED, at least a capacitor, for driving the OLED to emit light; the plurality of control signal output units respectively receiving a feedback control signal reflecting the ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle; for more aged OLED, the corresponding adjustable light-emitting control signal controlling the light emission time of the pixel light-emitting driver unit to become longer in a frame cycle; wherein one control signal output unit being disposed to correspond to a column of pixel light-emitting driver units; the n-th control signal output unit receiving the n-th feedback control signal reflecting the ageing information of the OLED in the n-th column of pixels of the OLED display panel and correspondingly outputting an n-th adjustable light-emitting control signal to the n-th column of pixel light-emitting driver units to adjust the light emission time of the n-th column of pixel light-emitting driver units in a frame cycle; wherein the pixel light-emitting driver unit comprising a first TFT, a second TFT, a third TFT, a capacitor, and an OLED; for the pixel light-emitting driver unit at the n-th column m-th row, the first TFT having the gate connected to receive the n-th adjustable light-emitting control signal, the source connected to the positive voltage of a power source, and the drain connected to the source of the second TFT; the second TFT having the gate connected to a node and the drain connected to the anode of the OLED; the third TFT having the gate connected to receive the scan signal from the n-th scan line, source connected to receive the data signal from the m-th data line, and the drain connected to the node; the capacitor having one end connected to the node and the other connected to the anode of the OLED; and the cathode of the OLED being grounded; wherein the n-th feedback control signal and the n-th adjustable light-emitting control signal being both single pulse signals, with opposite voltage level.

Compared to the known techniques, the present invention provides the following advantages: the present invention provides a driver circuit for OLED display panel, which comprises: a plurality of control signal output units, and a plurality of pixel light-emitting driver units arranged in an array form the plurality of control signal output units respectively receiving a feedback control signal reflecting the ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle so as to compensate the reduced luminance caused by aged OLED and improve the uneven luminance problem of OLED display panel.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

The present invention provides a driver circuit for OLED display panel.

Figure 1:
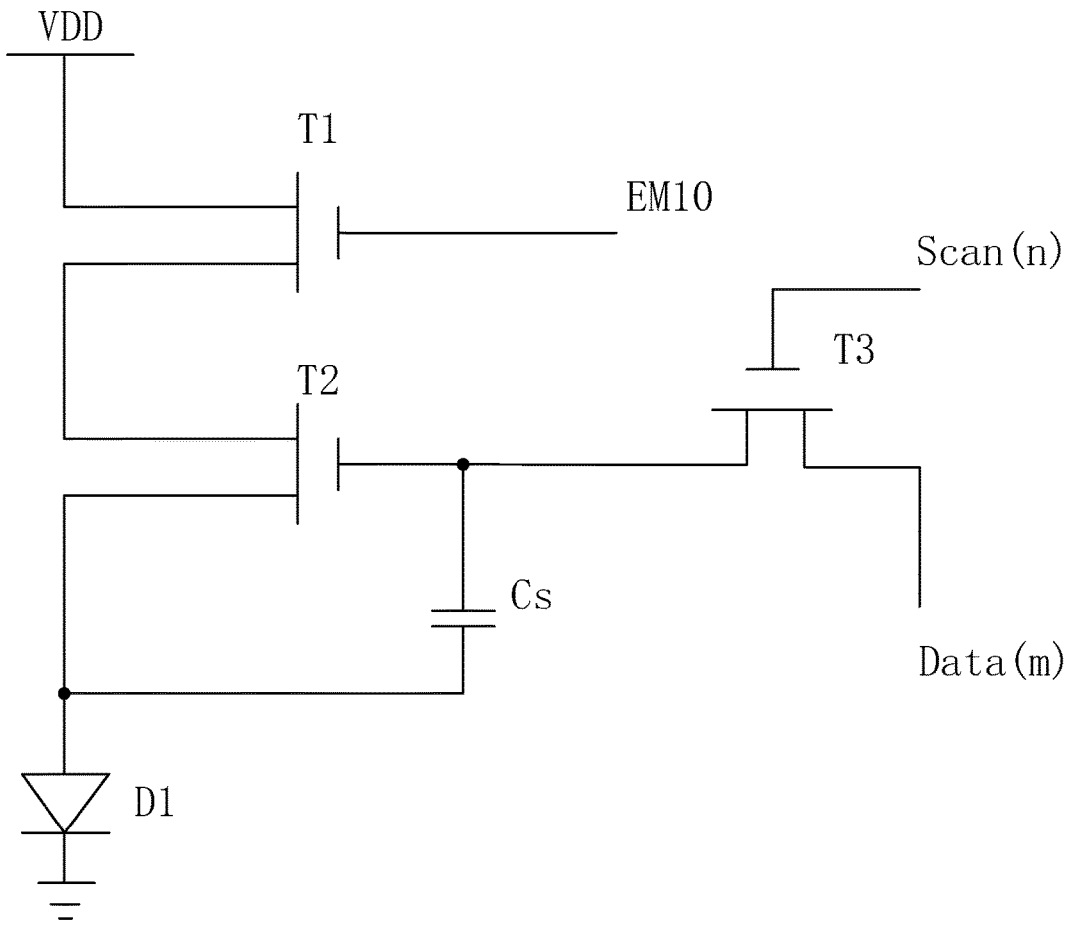
FIG. 1 is a schematic view showing a known driver circuit for OLED display panel.
Figure 2:
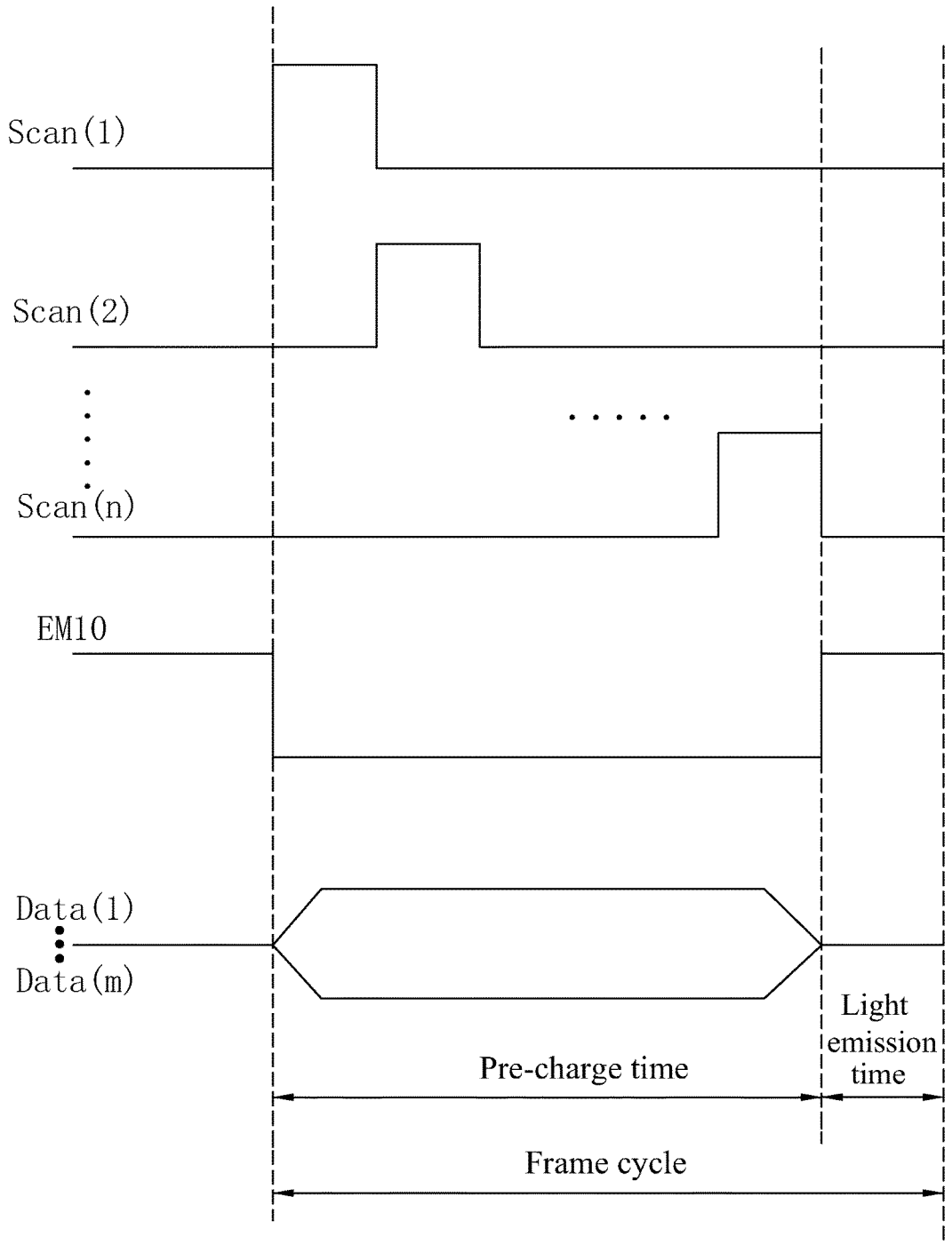
FIG. 2 is a schematic view showing the timing diagram for the driver circuit for OLED of FIG. 1.
Figure 3:
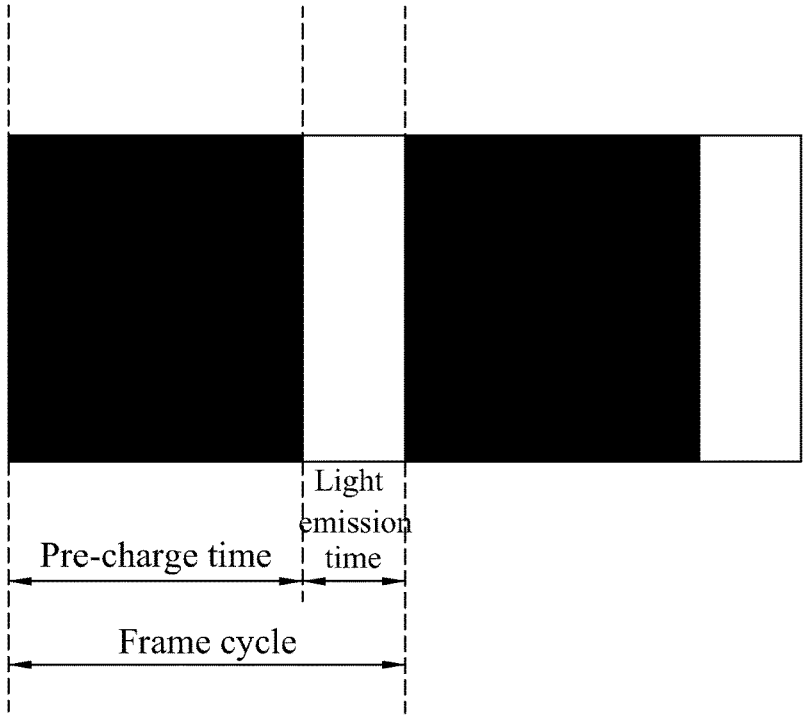
FIG. 3 is a schematic view showing the duty cycle of the pre-charge time and light emission time in a frame cycle under the timing diagram of FIG. 2 for the driver circuit for OLED of FIG. 1.
Figure 4:
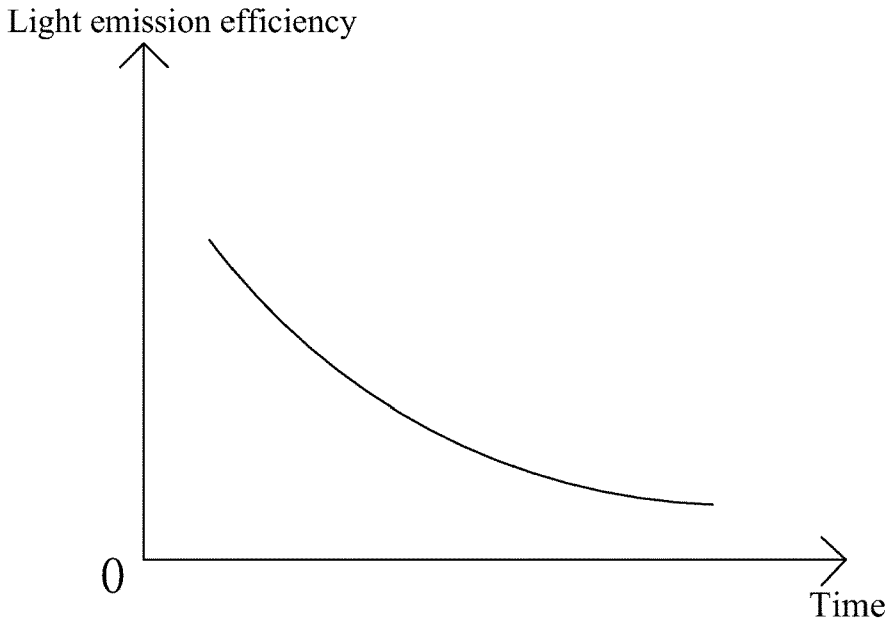
FIG. 4 is a schematic view showing the diagram of OLED light emission efficiency changes versus time.
Figure 5:
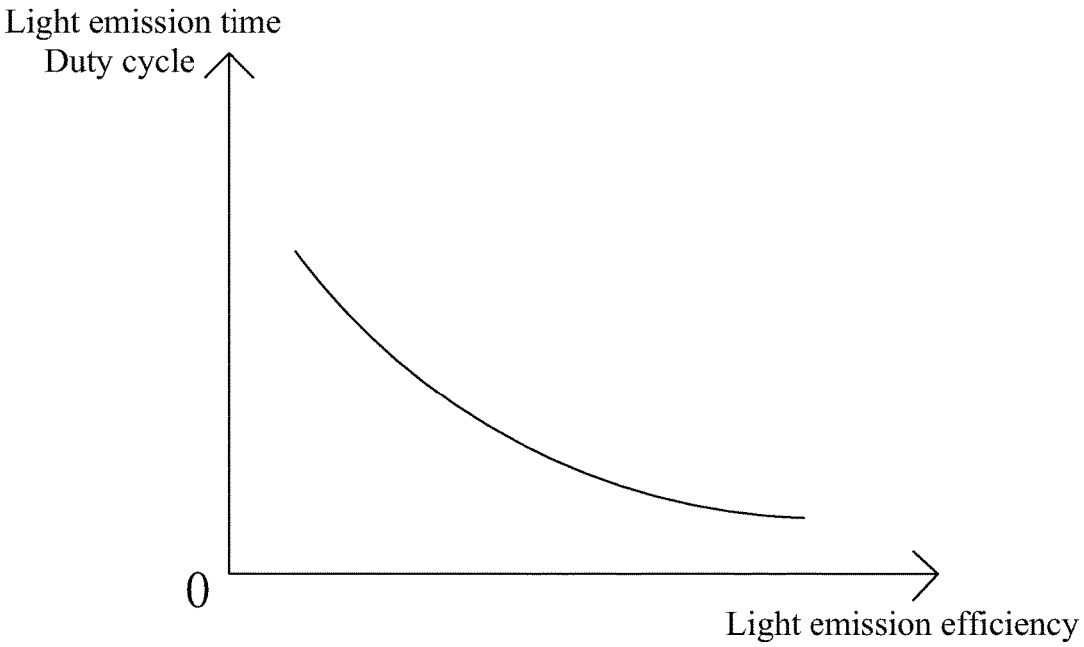
FIG. 5 is a schematic view showing relation diagram between the OLED light emission time and OLED light emission efficiency without reducing the luminance.

The driver circuit for OLED display panel provided by the present invention is based on the following operation principle: as shown in FIG. 4, the light emission efficiency of OLED will decrease as the OLED operates for a long time and aged, which leads to reduced luminance. Therefore, to maintain the luminance without changing the OLED light emission efficiency, the solution is, as shown in FIG. 5, to change the duty cycle of the light emission time of the OLED. In other words, the higher the OLED light emission efficiency is and less aged the OLED is, the duty cycle of the light emission time of the OLED is smaller and the light emission time for the OLED is shorter; on the other hand, the lower the OLED light emission efficiency is and more aged the OLED is, the duty cycle of the light emission time of the OLED is larger and the light emission time for the OLED is longer.

Figure 6:
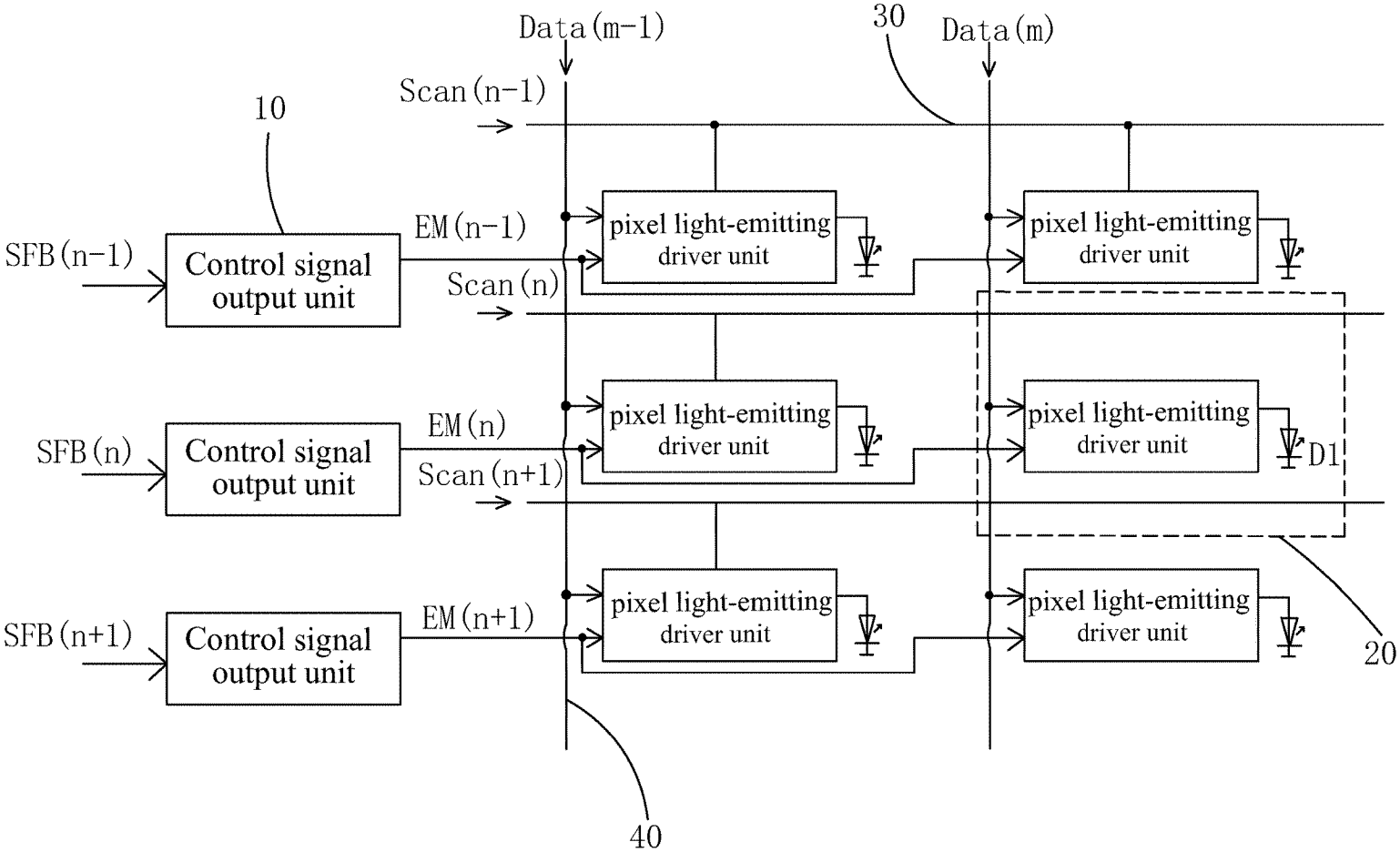
FIG. 6 is a schematic view showing the structure of the driver circuit for OLED display panel provided by an embodiment of the present invention.

Refer to FIG. 6, the driver circuit for OLED display panel of the present invention comprises: a plurality of control signal output units 10, a plurality of pixel light-emitting driver units 20 arranged in an array form, an n-th scan line 30, numbered from top, disposed along a horizontal direction corresponding to an n-th column of pixel light-emitting driver units 20, and an m-th data line 40, numbered from left, disposed along a vertical direction corresponding to an m-th row of pixel light-emitting driver units 20, wherein n and m both positive integers.

The scan line 30 is for transmitting a scan signal, and the data line 40 is for transmitting a data signal.

The pixel light-emitting driver unit 20 comprises a plurality of thin film transistors (TFT), an organic OLED D1, at least a capacitor, for driving the OLED D1 to emit light.

Each of the plurality of control signal output units 10 respectively receives a feedback control signal reflecting the ageing information of the OLED in a different active area of the OLED display panel, and each control signal output unit 10 correspondingly outputs an adjustable light-emitting control signal to at least a pixel light-emitting driver unit 20 according to the received feedback control signal to adjust the light emission time of the corresponding pixel light-emitting driver unit 20 in a frame cycle. For more aged OLED D1, the corresponding adjustable light-emitting control signal controls the light emission time of the pixel light-emitting driver unit 20 to become longer in a frame cycle so as to compensate the reduced luminance caused by aged OLED and improve the uneven luminance problem of OLED display panel.

For the convenience of circuit layout, as shown in FIG. 6, a control signal output unit 10 is disposed to correspond to a column of pixel light-emitting driver units 20. The n-th control signal output unit 10 receives the n-th feedback control signal SFB(n) reflecting the ageing information of the OLED in the n-th column of pixels of the OLED display panel and correspondingly outputting an n-th adjustable light-emitting control signal EM(n) to the n-th column of pixel light-emitting driver units 20 to adjust the light emission time of the n-th column of pixel light-emitting driver units 20 in a frame cycle. Of course, the present invention is not limited to dispose one control signal output unit 10 to correspond to a column of pixel light-emitting driver units 20. In other embodiments, a control signal output unit 10 can be disposed to correspond to one or a plurality of pixel light-emitting driver units 20 for more precise controlling.

Specifically, the pixel light-emitting driver unit 20 comprises a first TFT T1, a second TFT T2, a third TFT T3, a capacitor Cs, and an OLED D1; for the pixel light-emitting driver unit 20 at the n-th column m-th row, the first TFT T1 having the gate connected to receive the n-th adjustable light-emitting control signal EM(n), the source connected to the positive voltage VDD of a power source, and the drain connected to the source of the second TFT T2; the second TFT T2 having the gate connected to a node A and the drain connected to the anode of the OLED D1; the third TFT T3 having the gate connected to receive the scan signal Scan(n) from the n-th scan line 30, source connected to receive the data signal Data(m) from the m-th data line 40, and the drain connected to the node A; the capacitor Cs having one end connected to the node A and the other connected to the anode of the OLED D1; and the cathode of the OLED D1 being grounded. Of course, the pixel light-emitting driver unit 20 may further comprise additional TFTs and capacitors to compensate the threshold voltage shift.

The gate of the first TFT T1 is controlled by the n-th adjustable light-emitting control signal EM(n) to specifically control the light emission time of the OLDD1 of the pixel light-emitting driver unit; the second TFT T2 is for driving the OLED D1 to emit light; and the third TFTT3 is for pre-charging the capacitor Cs. Optionally, the TFTs are N-type TFTs, as shown in FIG. 7, or alternatively P-type TFTs, as long as the voltage levels of the signals are changed to suit the N-type or P-type TFT characteristics.

Furthermore, the n-th feedback control signal SFB(n) and the n-th adjustable light-emitting control signal EM(n) are both single pulse signals, with opposite voltage level.

Figure 8:
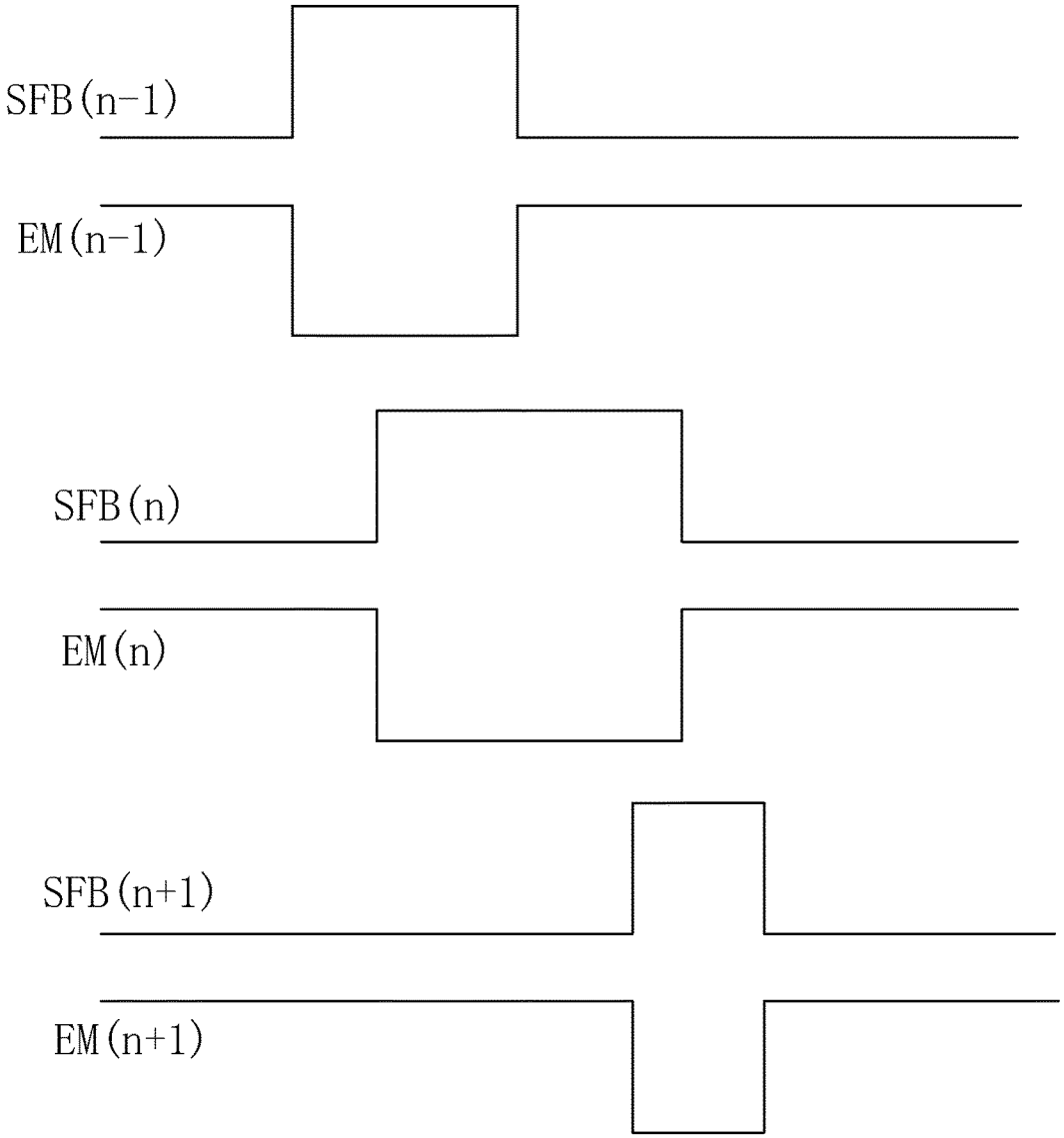
FIG. 8 is a schematic view showing the inputted feedback control signals and outputted adjustable light-emitting control signals of three neighboring control signal output units for the driver circuit for OLED display panel of FIG. 6.
Figure 9:
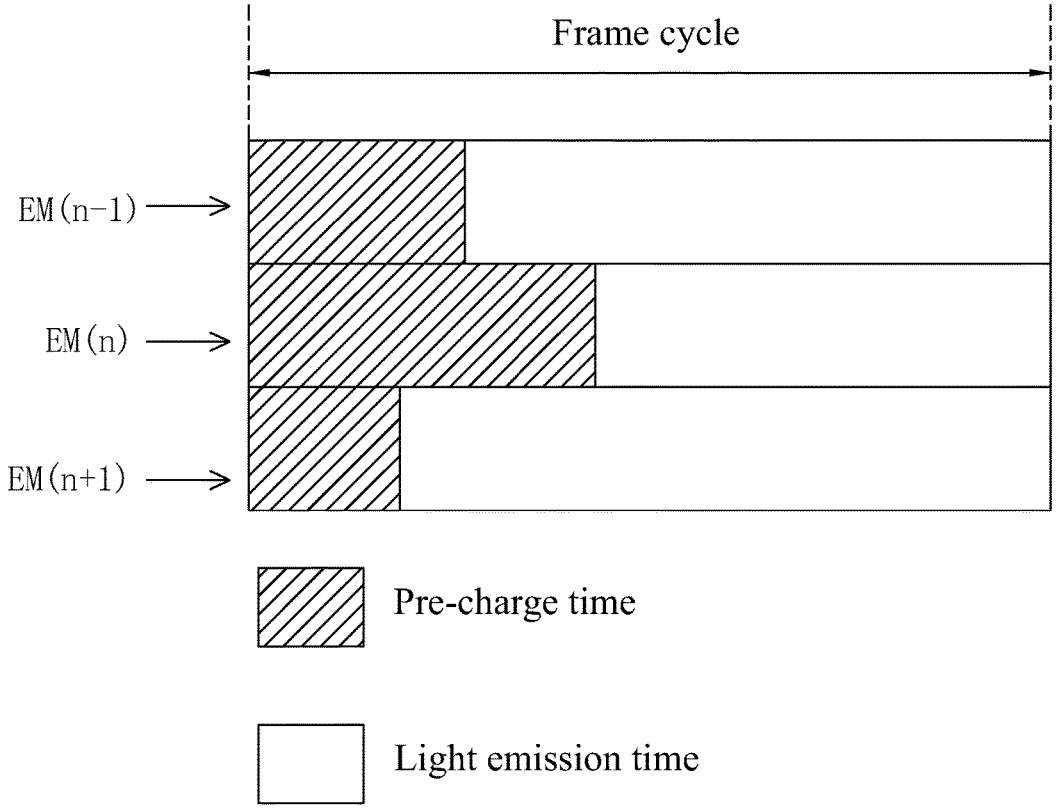
FIG. 9 is a schematic view showing the light emission times of three neighboring columns of pixels controlled by three neighboring adjustable light-emitting control signals of FIG. 8.

Refer to FIG. 8 and FIG. 9. For N-type TFTs in the pixel light-emitting driver unit 20, during the pre-charge time of the n-th columns of pixels, the n-th feedback control signal SFB(n) is high, and the duration at the high level for the n-th feedback control signal SFB(n) is determined by the ageing information of the OLEDs of the n-th column of pixel light-emitting driver units 20. The shorter the n-th feedback control signal SFB(n) stays at the high level, the shorter the time that the corresponding n-th adjustable light-emitting control signal EM(n) is low to cut off the first TFT F1 to stop the OLEDD1 from emitting light. During the light emission time of the n-th column of pixels, the n-th feedback control signal SFB(n) is low, the n-th adjustable light-emitting control signal EM(n) is high, and the OLED D1 emits light. Because in a frame cycle, the shorter the duty cycle of the pre-charge, the longer the duty cycle of the light emission time. As such, the increasing of the light emission time of the OLED D1 compensates the luminance reduction caused by ageing, and improves the uneven luminance problem in the OLED display panel.

Figure 7:
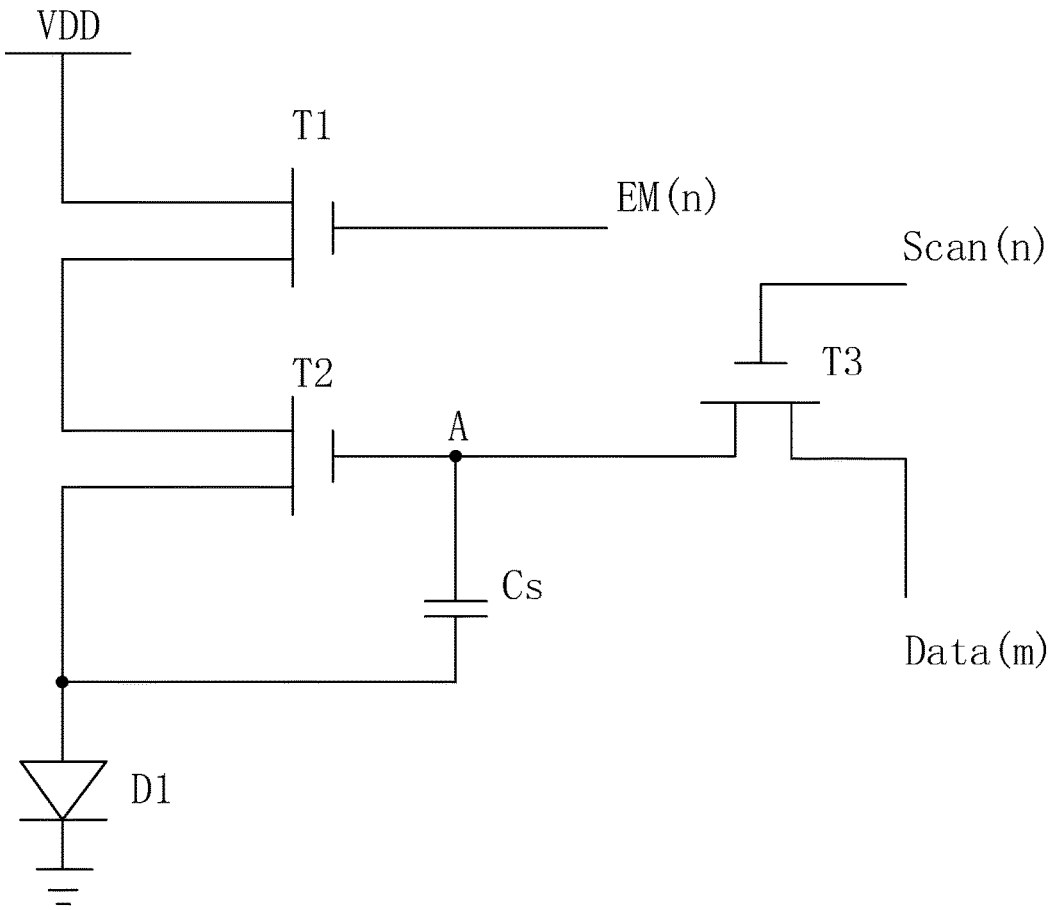
FIG. 7 is a schematic view showing the circuit of the pixel light-emitting driver unit of the driver circuit for OLED display panel provided by an embodiment of the present invention.

Refer to FIGS. 7, 8 and 9. Different control signal output units 10 output different adjustable light-emitting control signals EM(n−1), EM(n), EM(n+1) according to different feedback control signal SFB(n−1), SFB(n), SFB(n+1) reflecting respectively received ageing information of the OLEDS in different columns of pixels in different active area of the OLED display panel so that the light emission time is different for different column of pixels. As such, the object of self-adjusting the light emission time of corresponding pixels in a frame cycle according to OLED ageing extent is accomplished.

Similarly, for P-type TFTs in the pixel light-emitting driver unit 20, during the pre-charge time of the n-th columns of pixels, the n-th feedback control signal SFB(n) is low, and the duration at the low level for the n-th feedback control signal SFB(n) is determined by the ageing information of the OLEDs of the n-th column of pixel light-emitting driver units 20. The n-th adjustable light-emitting control signal EM(n) is high, while during the light emission time of the n-th column of pixels, the n-th feedback control signal SFB(n) is high, the n-th adjustable light-emitting control signal EM(n) is low.

In summary, the present invention provides a driver circuit for OLED display panel, which comprises: a plurality of control signal output units, and a plurality of pixel light-emitting driver units arranged in an array form the plurality of control signal output units respectively receiving a feedback control signal reflecting the ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle so as to compensate the reduced luminance caused by aged OLED and improve the uneven luminance problem of OLED display panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A driver circuit for OLED display panel, which comprises: a plurality of control signal output units, a plurality of pixel light-emitting driver units arranged in an array, an n-th scan line, numbered from top, disposed along a horizontal direction corresponding to an n-th column of pixel light-emitting driver units, and an m-th data line, numbered from left, disposed along a vertical direction corresponding to an m-th row of pixel light-emitting driver units, wherein n and in are both positive integers;

the pixel light-emitting driver unit comprising a plurality of thin film transistors (TFT), an organic OLED, and at least a capacitor, for driving the OLED to emit light;

each of the plurality of control signal output units respectively receiving a feedback control signal reflecting ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle such that for a more aged OLED, the corresponding adjustable light-emitting control signal controls the light emission time of the pixel light-emitting driver unit to become longer in a frame cycle; and wherein the light emission time defines a segment of a time interval of the frame cycle in which the OLED emits light and the light emission time of the OLED in a first active area of the OLED display panel is set according to the received feedback control signal and is different from the light emission time of the OLED of a second active area of the OLED display panel.

2. The driver circuit for OLED display panel as claimed in claim 1, wherein each control signal output unit is disposed to correspond to a column of pixel light-emitting driver units; the n-th control signal output unit receives the n-th feedback control signal reflecting the ageing information of the OLED in the n-th column of pixels of the OLED display panel and correspondingly outputs an n-th adjustable light-emitting control signal to the n-th column of pixel light-emitting driver units to adjust the light emission time of the n-th column of pixel light-emitting driver units in a frame cycle.

3. The driver circuit for OLED display panel as claimed in claim 2, wherein the pixel light-emitting driver unit comprises a first TFT, a second TFT, a third TFT, a capacitor, and an OLED; for the pixel light-emitting driver unit at the n-th column m-th row, the first TFT has a gate connected to receive the n-th adjustable light-emitting control signal, a source connected to a positive voltage of a power source, and a drain connected to a source of the second TFT; the second TFT has a gate connected to a node and a drain connected to an anode of the OLED; the third TFT has a gate connected to receive a scan signal from the n-th scan line, a source connected to receive a data signal from the m-th data line, and a drain connected to the node; the capacitor has one end connected to the node and other end connected to the anode of the OLED; and a cathode of the OLED is grounded.

4. The driver circuit for OLED display panel as claimed in claim 2, wherein the n-th feedback control signal and the n-th adjustable light-emitting control signal are both single pulse signals, with opposite voltage level.

5. The driver circuit for OLED display panel as claimed in claim 4, wherein the TFTs are N-type TFTs, and during the pre-charge time of the n-th columns of pixels, the n-th feedback control signal is high, the n-th adjustable light-emitting control signal is low, while during the light emission time of the n-th column of pixels, the n-th feedback control signal is low, the n-th adjustable light-emitting control signal is high.

6. The driver circuit for OLED display panel as claimed in claim 5, wherein the duration at the high level for the n-th feedback control signal is determined by the ageing information of the OLEDs of the n-th column of pixel light-emitting driver units.

7. The driver circuit for OLED display panel as claimed in claim 4, wherein the TFTs are P-type TFTs, and during the pre-charge time of the n-th column of pixels, the n-th feedback control signal is low, the n-th adjustable light-emitting control signal is high, while during the light emission time of the n-th column of pixels, the n-th feedback control signal is high, the n-th adjustable light-emitting control signal is low.

8. The driver circuit for OLED display panel as claimed in claim 7, wherein the duration at the low level for the n-th feedback control signal is determined by the ageing information of the OLEDs of the n-th column of pixel light-emitting driver units.

9. A driver circuit for OLED display panel, which comprises: a plurality of control signal output units, a plurality of pixel light-emitting driver units arranged in an array form, an n-th scan line, numbered from top, disposed along a horizontal direction corresponding to an n-th column of pixel light-emitting driver units, and an m-th data line, numbered from left, disposed along a vertical direction corresponding to an m-th row of pixel light-emitting driver units, wherein n and in are both positive integers;

the pixel light-emitting driver unit comprising a plurality of thin film transistors (TFT), an organic OLED, and at least a capacitor, for driving the OLED to emit light;

each of the plurality of control signal output units respectively receiving a feedback control signal reflecting ageing information of the OLED in a different active area of the OLED display panel, and each control signal output unit correspondingly outputting an adjustable light-emitting control signal to at least a pixel light-emitting driver unit according to the received feedback control signal to adjust the light emission time of the corresponding pixel light-emitting driver unit in a frame cycle such that for a more aged OLED, the corresponding adjustable light-emitting control signal controls the light emission time of the pixel light-emitting driver unit to become longer in a frame cycle;

wherein the light emission time defines a segment of a time interval of the frame cycle in which the OLED emits light and the light emission time of the OLED in a first active area of the OLED display panel is set according to the received feedback control signal and is different from the light emission time of the OLED of a second active area of the OLED display panel;

wherein each control signal output unit is disposed to correspond to a column of pixel light-emitting driver units; the n-th control signal output unit receives the n-th feedback control signal reflecting the ageing information of the OLED in the n-th column of pixels of the OLED display panel and correspondingly outputs an n-th adjustable light-emitting control signal to the n-th column of pixel light-emitting driver units to adjust the light emission time of the n-th column of pixel light-emitting driver units in a frame cycle;

wherein the pixel light-emitting driver unit comprises a first TFT, a second TFT, a third TFT, a capacitor, and an OLED; for the pixel light-emitting driver unit at the n-th column m-th row, the first TFT has a gate connected to receive the n-th adjustable light-emitting control signal, a source connected to a positive voltage of a power source, and a drain connected to a source of the second TFT; the second TFT has a gate connected to a node and a drain connected to an anode of the OLED; the third TFT has a gate connected to receive a scan signal from the n-th scan line, a source connected to receive a data signal from the m-th data line, and a drain connected to the node; the capacitor having one end connected to the node and other end connected to the anode of the OLED; and a cathode of the OLED is grounded;

wherein the n-th feedback control signal and the n-th adjustable light-emitting control signal being both single pulse signals, with opposite voltage level.

10. The driver circuit for OLED display panel as claimed in claim 9, wherein the TFTs are N-type TFTs, and during the pre-charge time of the n-th columns of pixels, the n-th feedback control signal is high, the n-th adjustable light-emitting control signal is low, while during the light emission time of the n-th column of pixels, the n-th feedback control signal is low, the n-th adjustable light-emitting control signal is high.

11. The driver circuit for OLED display panel as claimed in claim 10, wherein the duration at the high level for the n-th feedback control signal is determined by the ageing information of the OLEDs of the n-th column of pixel light-emitting driver units.

12. The driver circuit for OLED display panel as claimed in claim 9, wherein the TFTs are P-type TFTs, and during the pre-charge time of the n-th column of pixels, the n-th feedback control signal is low, the n-th adjustable light-emitting control signal is high, while during the light emission time of the n-th column of pixels, the n-th feedback control signal is high, the n-th adjustable light-emitting control signal is low.

13. The driver circuit for OLED display panel as claimed in claim 10, wherein the duration at the low level for the n-th feedback control signal is determined by the ageing information of the OLEDs of the n-th column of pixel light-emitting driver units.

* * * * *